US005128180A

United States Patent [19]

Acton

[11] Patent Number: 5,128,180

[45] Date of Patent: Jul. 7, 1992

[54] COLLAPSIBLE FRAMEWORK FOR AN ARTIFICIAL TREE

[76] Inventor: Hugh C. Acton, 7801 N. 46th St., Augusta, Mich. 49012

[21] Appl. No.: 692,269

[22] Filed: Apr. 26, 1991

[51] Int. Cl.[5] ..... A47G 33/06

[52] U.S. Cl. ..... 428/20; 428/27; 493/956

[58] Field of Search ..... 428/12, 18, 19, 20, 428/27, 17; 211/195, 196, 205; 248/175; 493/956

[56] References Cited

U.S. PATENT DOCUMENTS

| | | | |
|---|---|---|---|
| 760,879 | 5/1904 | Kunzman | 248/175 X |
| 1,590,220 | 6/1926 | Wurts | 428/20 X |
| 1,617,494 | 2/1927 | Nuckols | 248/175 X |
| 1,654,427 | 12/1927 | Modlarz | 428/20 X |
| 2,586,791 | 2/1952 | Dattilo | 428/12 |
| 2,801,107 | 7/1957 | Greer, Jr. | 428/20 X |
| 3,647,605 | 3/1972 | Spiegel | 428/18 X |
| 3,692,617 | 9/1972 | Marks et al. | 428/20 |
| 4,285,163 | 8/1981 | Booker, Jr. | 211/195 X |
| 5,085,901 | 2/1992 | Johnson et al. | 428/20 X |

FOREIGN PATENT DOCUMENTS

| | | | |
|---|---|---|---|
| 1300652 | 8/1969 | Fed. Rep. of Germany | 428/20 |

*Primary Examiner*—Henry F. Epstein

*Attorney, Agent, or Firm*—Varnum, Riddering, Schmidt & Howlett

[57] ABSTRACT

A separable framework for an artificial tree comprising a plurality of vertically stacked, separable and telescopically collapsible frame sections diminishing progressively in transverse dimension from the lowermost to the uppermost thereof. Each of the frame sections above the lowermost is support on the frame section immediately below in the stacked or erected condition, but is resiliently moveable to a condition in which it is separable from and telescopically received within the frame section immediately below to permit the framework to be collapsed.

40 Claims, 4 Drawing Sheets

COLLAPSIBLE FRAMEWORK FOR AN ARTIFICIAL TREE

This invention relates generally to a simulated or artificial tree and a framework therefor, and, more particularly, to a separable, collapsible framework for constructing artificial trees suitable for decoration and display during the festive season which in many cultures attends the winter solstice or the rounding of the year.

BACKGROUND OF THE INVENTION

The custom of decorating trees is inseparably associated with the Christmas holiday in many parts of the world, but it is also a feature of secular New Year's celebrations in certain countries in which the observance of the Christmas holiday is not widespread or is not officially sanctioned. Whatever the occasion, evergreen trees of dense foliage, including such North American varieties commonly known as Balsam Fir and Spruce, have historically been preferred for decoration. Such trees naturally conform to a tapering or conical shape and it is this shape that is symbolic of the traditional holiday tree.

Decorated trees in every imaginable variety of artificial material have long been employed, especially in public displays of the sort featured by merchants during the Christmas shopping season.

Many artificial trees are designed to be dismantled so that they may be stored in comparatively compact containers. An example of such a collapsible tree is found in W. Wurts U.S. Pat. No. 1,590,220, issued Jun. 29, 1926, in the form of a vertical post upon which are supported a plurality of arms or branches.

Another type of collapsible tree incorporates a plurality of concentric rings of varying diameter to create the conical tree shape. This type is represented by T. Modlarz U.S. Pat. No. 1,654,427, issued Dec. 27, 1927, and T. Marks et al U.S. Pat. No. 3,692,617, issued Sep. 19, 1972. The rings of Modlarz are supported by a plurality of removable arms, whereas the rings of Marks et al. are supported by four generally vertical wire members.

A further example of an artificial tree is disclosed in S. I. Spiegel U.S. Pat. No. 3,647,605, issued Mar. 7, 1972, and comprises a basketlike framework for supporting branches and ornaments. However, this configuration is not collapsible. Indeed, none of the artificial trees known from the references identified hereinabove are easily collapsed or assembled and none are collapsed telescopically.

SUMMARY OF THE INVENTION

The present invention represents an improvement over the prior art by providing a separable and collapsible framework for an artificial tree. More particularly, a framework according to the present invention can be separated into its individual component parts or easily collapsed telescopically. Similarly, it is easily assembled and erected or reerected.

The framework comprises a plurality of vertically stacked frame sections separable from one another and telescopically collapsible. The frame sections increase in transverse dimension from the top of the framework to the bottom thereof. The framework may be separated into the individual frame sections or, alternatively, the frame sections may be telescopically collapsed in a manner such that each of the frame sections above a lowermost frame section is receivable within the frame section immediately below. Each frame section comprises a plurality of support members with connecting means mounted thereon suitable for engaging and supporting the frame section on the frame section immediately below it in the stacked condition. The connecting means are selectively movable into and out of engagement to permit the upper section to be collapsed into the frame section below. Alternatively, the connecting means may be adapted to engage the frame section immediately above in the stacked condition.

In one embodiment, the support members of the frame sections are biased to maintain the connecting means in engagement with the frame section immediately below. Preferably, the connecting means comprise a U-shaped connector mounted at one end of the support members.

In a further modification, the lowermost section is separably and telescopically mounted on a base section adapted to support the framework on a horizontal surface in the erect condition. The base section may be separated from the remainder of the framework and is adapted to telescopically receive the framework in the collapsed condition.

Each frame section further comprises a closed perimetric member which is adapted to receive or be engaged by the connector means of the frame section immediately above. Preferably, the perimetric members are closed curves or hoops, but may be adapted to a wide variety of closed curve shapes or other geometric figures such as ellipses, squares, triangles and trapezoids.

In one embodiment, the uppermost section of the framework is conical in shape and carries a mounting tube at its peak, the mounting tube being suitable for supporting decorations.

The support members may take many different shapes depending upon the configuration, silhouette or profile intended for the framework. In one embodiment, the support members extend merely radially outwardly and downwardly from one hoop section to another. In another embodiment, the support members comprise a first arm at the upper end thereof which is horizontal and a second arm at the lower end thereof which extends radially outwardly and downwardly. In a modification of such an embodiment, the first arm extends radially inwardly and downwardly and the second arm extends radially outwardly and downwardly.

These and other objects, features and advantages of the invention will be apparent from the ensuing description in conjunction with the accompanying drawings.

THE ILLUSTRATED EMBODIMENTS

Figure 1:
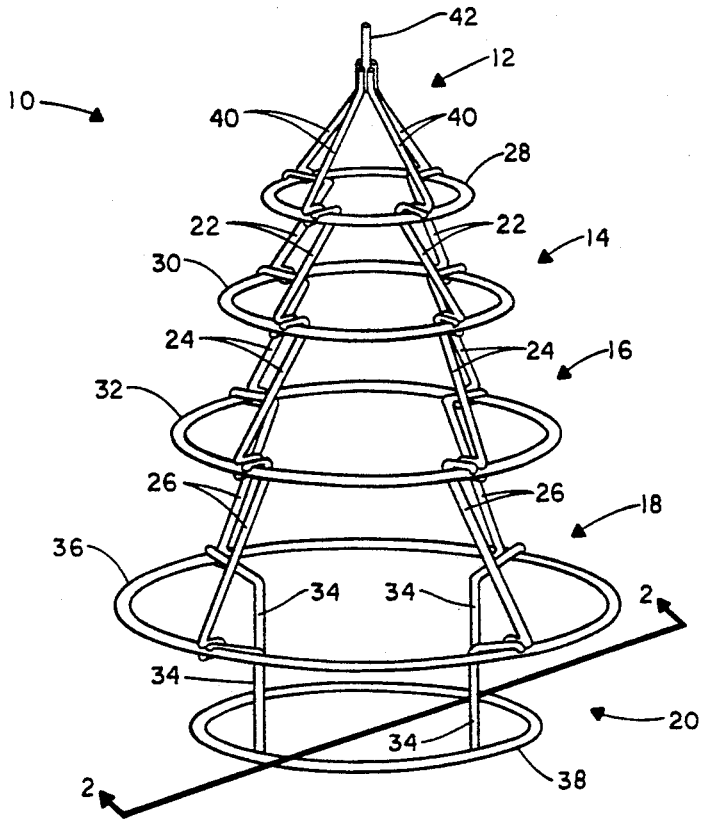
FIG. 1 is a perspective view from above and one side of a first embodiment of a framework according to the invention in an erected condition.

Referring particularly to FIG. 1, a framework 10 is shown in its erected condition, in which it conforms generally to the configuration of a right circular cone, though other configurations may be substituted. More particularly, the framework 10 comprises a plurality of frame sections stacked vertically upon another. These sections comprise a finial frame section 12, an upper frame section 14, an intermediate frame section 16, and a lowermost frame section 18. Preferably, the lowermost frame section is mounted on a base 20, suitable for supporting the framework on a horizontal surface.

Each individual frame section generally comprises a plurality of support members and a parallel horizontal perimetric member. In the illustrated embodiments, the perimetric members are in the shape of circular rings. The lowermost frame section 18 comprises a plurality of lowermost support members 26 and a lowermost ring 32. The intermediate frame section comprises a plurality of intermediate support members 24 and an intermediate ring 30. The upper frame section comprises a plurality of upper support members 22 and an upper ring 28. As will be discussed with greater particularity hereinbelow, the configuration of the support members may take many different shapes to vary the overall design of the framework 10.

The finial frame section 12 comprises a plurality of finial support members 40, one end of which terminates at the apex of the framework. A mounting tube 42 may be fixedly attached to the apex of the finial section 12 and used to support a star, a figurine or other decoration commonly found at the peak of a decorated artificial tree.

The base section 20 comprises a plurality of base support members 34 and a pair of rings, namely an upper base ring 36, and a lower base ring 38 which comprises a suitable support element for supporting the framework 10 on a horizontal surface. The upper base ring 36 is suitable to mount the lowermost support member 26 as will be discussed further hereinbelow. As a matter of design, the lower base ring 38 is of smaller circumference than the upper base ring 36. These relative sizes simulate the narrower, exposed lower trunk portion of a real evergreen tree. The relative circumference of the lower base ring may be altered depending upon the desired aesthetic effect.

Central to the invention is the vertically stacked relationship of the open framework sections and the separable nature of the individual frame sections. The vertical stacking relationship permits the framework to be easily separated into its component parts or to be telescopically collapsed into a compact configuration which may be easily stored when not in use.

The connecting means for interconnecting adjacent frame sections is similar in each of them. Therefore, only the configuration and design of the connecting means for the intermediate frame section 16 is described herein in detail.

Figure 4:
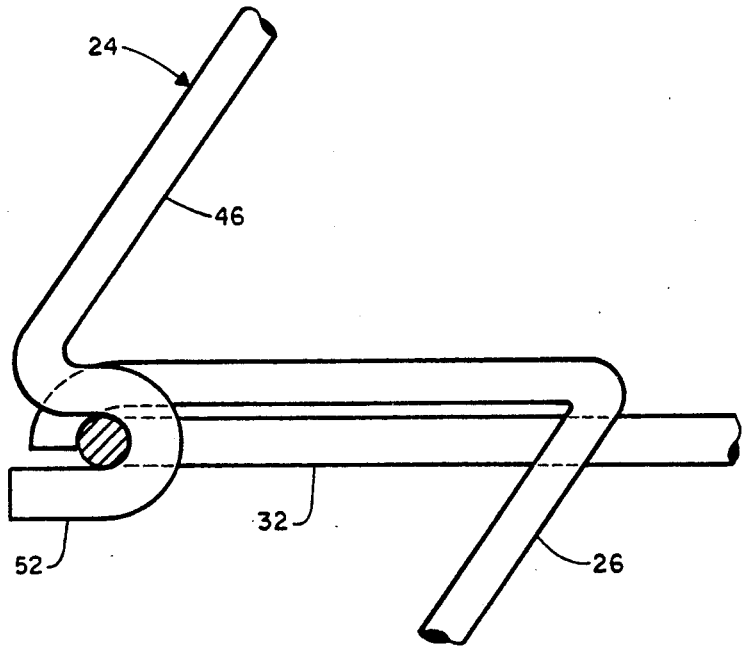
FIG. 4 is an enlarged partial view showing the connecting means for adjacent frame sections of a framework according to the invention.
Figure 2:
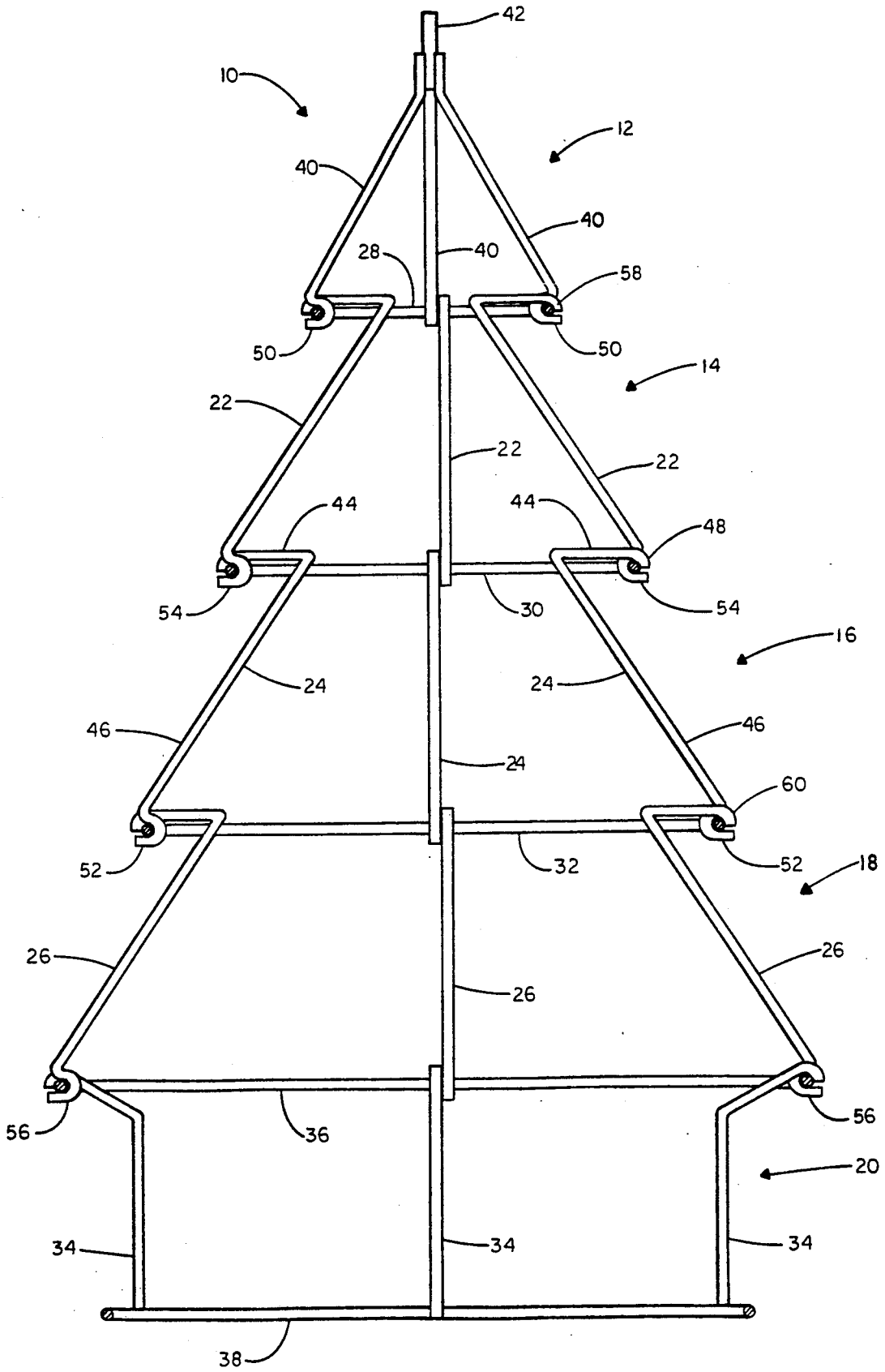
FIG. 2 is an enlarged sectional view of the framework of FIG. 1, taken along line 2—2 thereof.

As seen in FIGS. 2 and 4, the intermediate frame section 16 comprises a plurality of intermediate support members 24 and an intermediate ring 30. A first end 48 of the intermediate support member 24 is fixedly attached to the intermediate ring 30 by suitable means such as welding. The intermediate support members 24 are spaced about the perimeter of the ring 30. Referring particularly to FIG. 2, the intermediate support member 24 comprises a first arm 44 and a second arm 46. The first arm 44 is generally horizontal and extends radially inward from the intermediate ring 30, whereas the second arm 46 extends radially outward and downward. The second arm 46 terminates at an intermediate connector 52.

As seen more particularly in FIG. 4, connector 52 is U-shaped and receives the lowermost ring 32 of the subjacent lowermost frame section 18. The intermediate connector 52 supports the intermediate frame section 16 in a vertically stacked relationship on the lowermost frame section 18. The unique U-shaped configuration of the connector 52 provides a stable connection between the stacked frame sections, which results in a sturdy framework. Preferably, the opening of the U-shaped connector 52 is equal to or slightly more than the cross-sectional thickness of the lowermost ring 32. This permits close engagement between intermediate connector 52 and lowermost ring 32.

As stated above, the intermediate support members are fixedly attached about the perimeter of the intermediate ring 30. Therefore, the intermediate connectors 52, located at the radially outer corner of the intermediate support members 24, approximate the perimeter of the perimetric members. In the preferred embodiment, the diameter of the hoop defined by the intermediate connectors 52 is slightly larger than the diameter of the lowermost ring 32. Thus, when the intermediate connectors 52 are mounted on lowermost ring 16, they are slightly biased in the radially outward direction owing to the resilient nature of the framework wire. This bias further enhances the stability of the framework and prevents inadvertent disengagement of the connector.

As pointed out hereinabove, the other frame sections have a similar construction, including their connecting means.

The upper end 58 of the upper support member 22 is fixedly attached to the upper ring 28. The lower end of the upper support member 22 terminates in a U-shaped connector 54. Connector 54 engages the intermediate ring 30 and supports the upper frame section 14 on the intermediate frame section 16.

Similarly, the upper end 60 of the lowermost support member 26 is fixedly attached to the lowermost ring 32. The lowermost U-shaped connector 56 is mounted at the lower end of the lowermost support member 26 and the lowermost connectors 56 engage the upper base ring 36 of the base 20 and support the lowermost frame section 18 thereon.

The finial support members 40 of the finial frame section 12 similarly incorporate U-shaped connectors 50 at their respective radially outer corners, the connectors engaging the upper ring 28 of the upper frame section 14 to support the finial frame section thereon.

Figure 3:
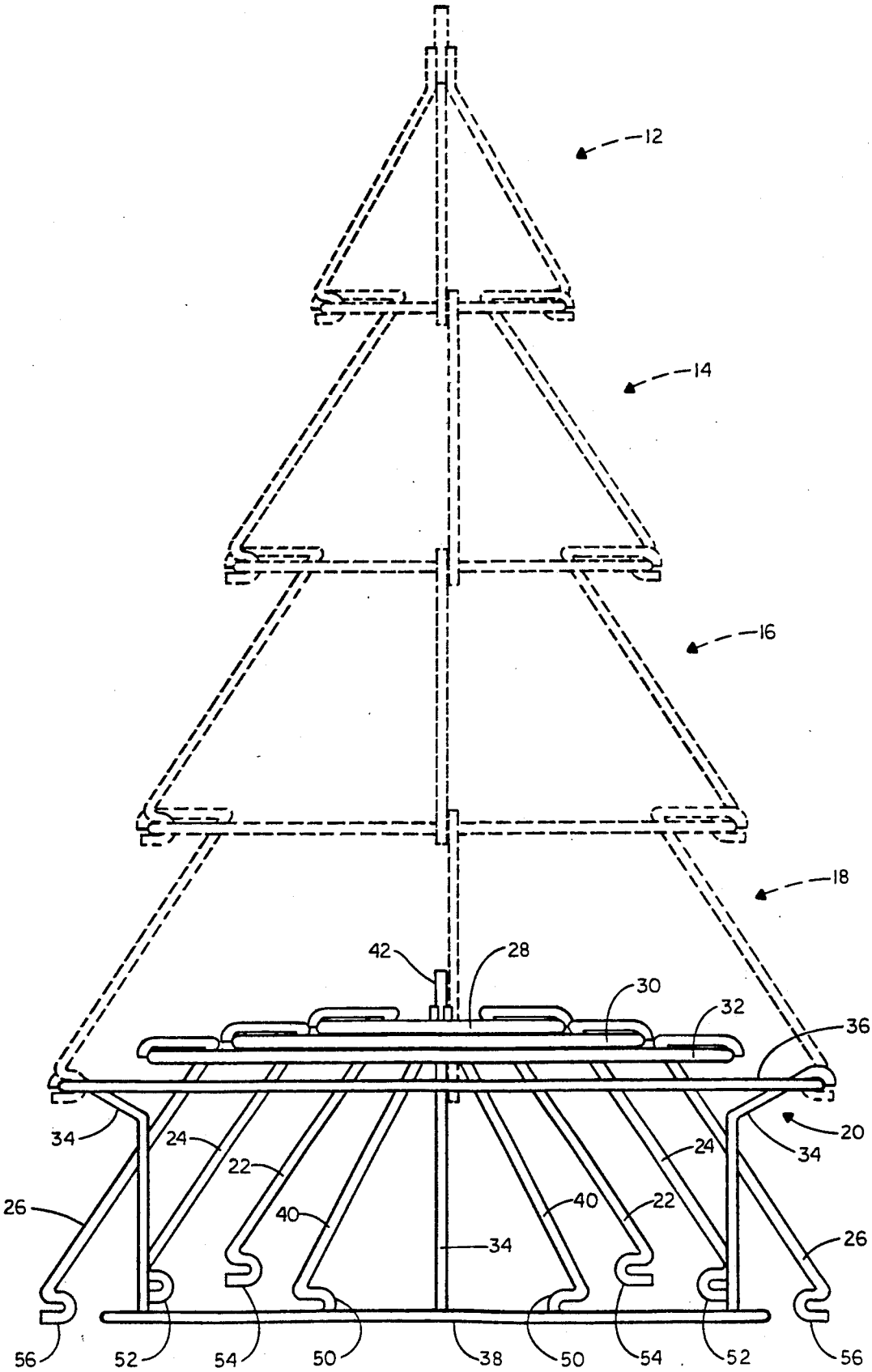
FIG. 3 is a side elevational view of the framework of FIGS. 1 and 2 in a collapsed condition, the erected condition being represented by interrupted lines.

As seen in FIG. 3, the erect framework 10 is easily separated or collapsed by merely flexing each of the support members inwardly until the corresponding U-shaped connectors are disengaged from the corresponding rings. For example, by applying a radially inward force to the lowermost connectors 56, the lowermost section 18 will become disengaged from the base 20. As a result, the lowermost frame section 18 will no longer be supported by base 20 and can be separated or telescopically collapsed within the base 20. Thereafter, a radially inward force may be applied to each of the intermediate connectors 52, disengaging them from the lowermost ring 32. Accordingly, the intermediate frame section will no longer be supported by the lowermost frame section and may be separated or telescopically collapsed therein.

The foregoing procedure may be repeated for each of the sections until the entire framework is separated into its component parts or collapsed as seen in FIG. 3.

To erect the framework from the collapsed state as seen in FIG. 3, the user merely lifts the finial section 12 until the finial connectors 50 engage the upper ring 28 of the upper frame section 14. Then, the user lifts the finial section 12 and the upper frame section 14 until the upper connectors 54 engage the intermediate ring 30 of the intermediate frame section 16. This process is repeated until the framework is in its fully erect condition as seen in FIG. 2.

Specific dimensions are not in any way critical to the invention and the person of ordinary skill in the art will readily arrive at dimensions appropriate to the purpose at hand. In preferred embodiments, steel wire is used to construct the framework, and the person of ordinary skill in the art will select the gauge of wire appropriate to the height of the framework. Additionally, the wire may be coated, as by a decorative gilt paint, or preferably, if the tree is to bear electric lights, an electrically insulating material may be used. Depending upon conditions of expected use, resilient materials other than steel wire may be substituted for the framework.

The framework of preferred embodiments is generally conical in shape and therefore the circumference of the horizontal perimetric members or rings diminishes from the lowermost ring to the uppermost ring. By merely altering the shape of the parallel horizontal perimetric member, several different framework designs may be achieved. It will be apparent that other closed curves such as ellipses might be substituted for the circular shape of the rings. Similarly, other geometric shapes such as squares, rectangles, triangles, and trapezoids may be substituted for the circular shape.

Further modifications may be achieved within the purview of the invention by altering the configuration of the support members. As shown in FIG. 2, the support members are formed with a horizontal first arm 44 which extends radially inwardly and a second arm 46 which extends radially outwardly and downwardly. This design can be easily modified to create a wide variety of artificial tree configurations. For example, the support member may be altered to eliminate the horizontal section so that it extends radially outwardly and downwardly from the intermediate ring 30 to the lowermost ring 32.

Figure 5:
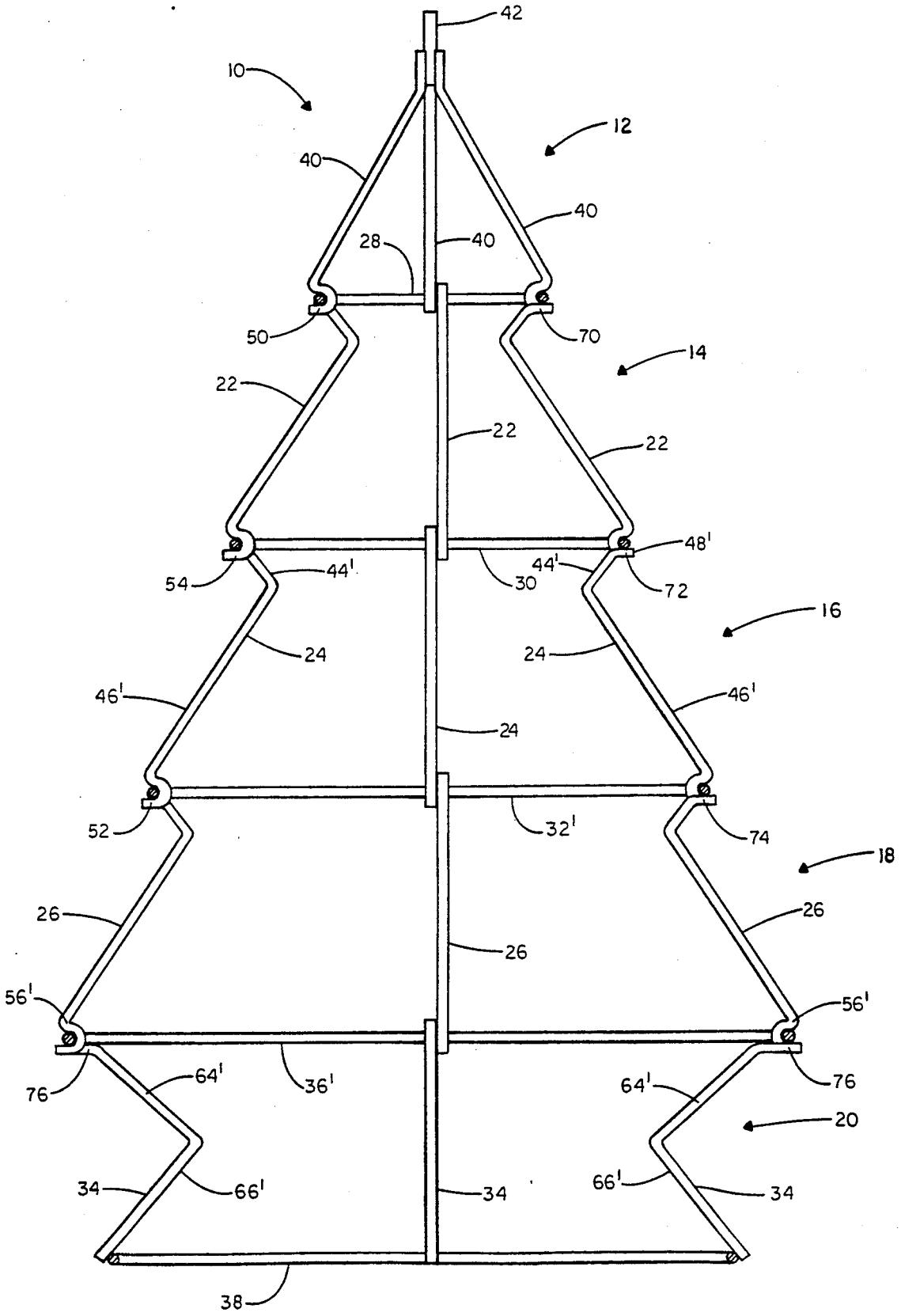
FIG. 5 is a sectional view similar to that of FIG 2 but showing a second embodiment of a framework according to the invention in an erected condition.

FIG. 5 discloses yet another embodiment for the shape of the support members. The support members for the upper frame section 14, the intermediate frame section 16 the lowermost frame section 18 and base 20 are similar and therefore only the support member for the intermediate frame section 16 will be described in detail.

The intermediate support member 24 comprises an intermediate mount arm 72, a first arm 44' and a second arm 46'. One end 48' of the intermediate mount arm 72' is fixedly attached to the intermediate ring 30 by suitable means such as welding. The first arm 44' extends from the other end of the intermediate mount arm 72 radially inwardly and downwardly from intermediate ring 30. Thereafter, the second arm 46' extends radially outwardly and downwardly from the other end of the first arm 44'. The intermediate connector 52 is mounted at the terminal end of the second arm 46' for separably mounting the intermediate frame section 16 to the lowermost frame section 18. As discussed above with respect to the first embodiment, the perimeter of the hoop defined by the intermediate connectors 52 may be slightly larger than that of the lowermost ring 32 whereby the support members are slightly biased radially outwardly when mounted to the lowermost ring 32.

Similarly to the intermediate support members 24, each of the upper support members 22 incorporates an upper mount arm 70, lowermost support member 26 incorporates a lowermost mount arm 74, and base support members 34 incorporate a base mount arm 76. However, the finial frame section 12 and corresponding finial support members 40 are of the same configuration as previously described.

Once the framework 10 is erected, it may be easily decorated with traditional decorations such as garland, electric lights, glass balls, or candles. Similarly, the framework 10 may be adapted for specific point of sale displays by merchants whereby a suitable display surface such as a flat shelf, suitably of transparent or translucent glass or mirrored glass, is supported by the various support members or the horizontal perimetric members. For example, a mirror with a circular perimeter (not shown) slightly smaller than that of intermediate ring 30, may be supported by the intermediate mounting arms 72, as seen in FIG. 5.

While the invention has been particularly described in connection with certain specific embodiments thereof, it is to be understood that this is by way of illustration and not of limitation, and the scope of the appended claims should be construed as broadly as the prior art will permit.

I claim:

1. A separable framework for an artificial tree comprising a plurality of vertically stacked and separable frame sections increasing in transverse dimension from the top of the framework to the bottom thereof, each one of the frame sections above a lowermost frame section being separable from the frame section immediately below said one frame section, the frame sections having a plurality of depending support members, and connecting means on the support members adapted to engage said frame section immediately below, whereby said one frame section is supported on said frame section immediately below in stacked relation thereto, the connecting means being selectively moveable into and out of engagement to permit said one frame section to be separated from said frame section immediately below.

2. A framework according to claim 1, wherein the support members of said one frame section are biased in a first radial direction to maintain the connecting means in engagement with said frame section immediately below and to permit manual displacement of the connecting means in a second radial direction opposite to the first radial direction to establish a separable relationship between said one frame section and said frame section immediately below.

3. A framework according to claim 1, wherein said one frame section is telescopically collapsible into said frame section immediately below.

4. A framework according to claim 1, wherein each of the connecting means comprises a U-shaped connector carried at a lower end of the support members.

5. A framework according to claim 1, including a base section having a support element, said lowermost frame section being telescopically mounted on the support element, the base section being adapted to support the framework in an erect position on a horizontal surface.

6. A framework according to claim 5, wherein the transverse dimension of the support element is smaller than the maximum transverse dimension of the lowermost frame section.

7. A framework according to claim 1, wherein an uppermost frame section of the framework is conical in form and other frame sections are frusto-conical in form, whereby the framework conforms generally to the configuration of a cone.

8. A framework according to claim 1, wherein each of the frame sections below an uppermost frame section thereof comprises a closed perimetric member adapted to receive the connector means of another frame section immediately above.

9. A separable framework for an artificial tree comprising:

a plurality of frame sections, each of the frame sections including:

a mounting member;

a plurality of support members, a first end of each of the support members being attached to the mounting member; and a connector at a second end of each of the support members;

said plurality of frame sections being vertically stacked in a manner whereby the connectors of a first frame section are selectively received by a mounting member of an adjacent frame section and said plurality of frame sections are separable.

10. A framework according to claim 9, wherein said first frame section is telescopically collapsible into said adjacent frame section.

11. A framework according to claim 9, wherein said adjacent frame section is telescopically collapsible into said first frame section.

12. A framework according to claim 9, wherein the frame sections increase in transverse dimension from the top of the framework to the bottom thereof.

13. A framework according to claim 9, wherein the support members of the frame sections are biased to maintain the connectors thereof in engagement with an adjacent frame section.

14. A framework according to claim 9, including a base section having a mounting member selectively engaged by the connectors of a lowermost one of the frame sections.

15. A framework according to claim 14, wherein the base section includes a support element formed to support the framework in an erected condition on a horizontal surface.

16. A framework according to claim 15, wherein the transverse dimension of the support element is smaller than the maximum transverse dimension of said lowermost frame section.

17. A framework according to claim 9, wherein an uppermost one of the frame sections is conical in form and other frame sections are frusto-conical in form, whereby the framework conforms generally to the configuration of a cone.

18. A framework according to claim 9, wherein each of the connectors is U-shaped.

19. A separable framework for an artificial tree, the framework being formed of wire in a generally conical configuration and comprising a plurality of concentric horizontal hoops diminishing progressively in circumference from a lowermost one thereof to an uppermost one thereof, and a plurality of vertically stacked and separable frame sections, each of the frame sections comprising at least one of the hoops and a plurality of support members disposed in an angularly spaced array and fixedly attached to said one hoop, the support members of the lowermost frame section being adapted to support the framework in an upright attitude on a horizontal surface, the support members of each one of the frame sections above the lowermost frame section overlying said one hoop of another frame section immediately below said one frame section in supported engagement therewith and being displaceable radially inwardly and out of said supported engagement to permit said one frame section to be separated from said other frame section immediately below.

20. A framework according to claim 19, wherein said frame sections are telescopically collapsible within the lowermost frame section whereby the fully collapsed height of the framework is equal to the height of the tallest of the frame sections.

21. A framework according to claim 19, wherein the support members of the uppermost of the frame sections converge upwardly to form an apex of the framework, whereby the uppermost frame section is conical in form and each of the other frame sections is frusto-conical in form.

22. A framework according to claim 19, wherein the support members of each frame section incorporate a U-shaped connector adapted to receive the hoop of an adjacent frame section.

23. A framework according to claim 19, wherein the support members are biased to maintain the connectors in engagement with the hoop of an adjacent frame section.

24. A framework according to claim 19, wherein the lowermost frame section is a base section which comprises a lower one of said hoops, a support hoop spaced below said lower hoop, and a plurality of support members extending between said lower hoop and the support hoop.

25. A framework according to claim 24, wherein the support hoop is adapted to support the framework in an erected condition on a horizontal surface.

26. A framework according to claim 24, wherein the transverse dimension of the support hoop is smaller than the maximum transverse dimension of the first-named hoops and the frame sections.

27. A separable framework for an artificial tree, comprising:

a plurality of parallel horizontal perimetric members defining geometrically similar closed plane figures;

a plurality of frame sections in a vertical stack thereof;

a lowermost one of the frame sections comprising;

a first one of the horizontal members disposed at an upper portion thereof;

a first set of support members disposed in an angularly spaced array and interconnected by the first horizontal member;

an upper frame section surmounting the lowermost frame section and comprising;

a second one of the horizontal members disposed at an upper portion thereof and enclosing an area smaller than the area enclosed by the first horizontal member;

a second set of support members disposed in an angularly spaced array and interconnected by the second horizontal member, each of the second set of support members extending generally downwardly and radially outwardly therefrom and terminating in a radially outer corner;

the second set of support members being formed of a resilient material to urge the respective outer corners in the radially outward direction;

each of the second set of support members being provided with a connector at the radially outer corner thereof for selective engagement with the first horizontal member of the lowermost frame section;

whereby the upper frame section is supported on the lowermost frame section by the connectors of the second set of support members and the outer corners of the second set of support members are displaceable radially with respect to the first horizontal member, whereby to disengage the connectors from the first horizontal member and thereby separate the upper frame section from the lowermost frame section.

28. A framework according to claim 27, wherein the upper frame section is telescopically collapsible within the lowermost frame section and the collapsed height of the framework is equal to the greater of the height of the lowermost frame section and the height of the upper frame section.

29. A framework according to claim 27, wherein the plane figures defined respectively by the plurality of horizontal members are closed curves whereby the framework is generally conical in form.

30. A framework according to claim 29, wherein the horizontal members are circular in shape.

31. A framework according to claim 27, wherein the connectors are U-shaped.

32. A framework according to claim 31, wherein the opening defined by each of the U-shaped connectors is at least equal to the cross-sectional thickness of the horizontal members.

33. A framework according to claim 27, wherein the area enclosed by each of the plurality of horizontal members diminishes progressively from the lowermost one thereof to the uppermost one thereof, whereby the framework tapers upwardly.

34. A framework according to claim 27, including a base section comprising a pair of the horizontal members and a plurality of support members interconnecting the pair of horizontal members, the base section and the first set of support members having interengaging means detachably securing the lowermost frame section to the base section to support the lowermost frame section and thereby the upper frame section in an upright position on a horizontal surface.

35. A framework according to claim 27, including a finial section comprising a mounting tube and a third set of support members disposed in an angularly spaced array interconnected by the mounting tube, extending downwardly and radially outwardly therefrom, and terminating in a radially outer corner; each of the third set of support members being formed of a resilient material to urge the respective outer corners thereof in the radially outward direction and being provided with a connector for selective engagement with said second horizontal member of the upper frame section;

whereby the finial section is supported on the upper frame section by the connectors of the third set of support members and the outer corners of the third set of support members are displaceable radially with respect to the second horizontal member to disengaging the connectors from the second horizontal member whereby the finial frame section may be separated from the upper frame section.

36. A framework according to claim 35, wherein the finial section is telescopically collapsible within the upper frame section.

37. A framework according to claim 35, wherein the mounting tube is adapted to carry preselected decorations at the peak of the framework in its erected state.

38. A framework according to claim 27, wherein each of the support members of the first and second sets thereof comprises a generally horizontal first arm at its upper end, and a second arm at its lower end directed radially outwardly.

39. A framework according to claim 27, wherein each of the support members of the first and second sets thereof comprises a first arm at its upper end directed radially inward and downwardly, and a second arm at its lower end directed radially downwardly and outwardly.

40. A framework according to claim 27, wherein a each of said first and second and second sets of support members are adapted to support a flat display shelf at the upper ends of the respective support members thereof.

* * * * *